US011266288B2

(12) United States Patent
Ziamandanis

(10) Patent No.: US 11,266,288 B2
(45) Date of Patent: Mar. 8, 2022

(54) DOUBLE-HANDLE MOP

(71) Applicant: Peter J. Ziamandanis, Loudonville, NY (US)

(72) Inventor: Peter J. Ziamandanis, Loudonville, NY (US)

( * ) Notice: Subject to any disclaimer, the term of this patent is extended or adjusted under 35 U.S.C. 154(b) by 497 days.

(21) Appl. No.: 16/188,710

(22) Filed: Nov. 13, 2018

(65) Prior Publication Data

US 2019/0246864 A1 Aug. 15, 2019

Related U.S. Application Data

(63) Continuation-in-part of application No. 16/042,291, filed on Jul. 23, 2018, now abandoned.

(60) Provisional application No. 62/630,933, filed on Feb. 15, 2018.

(51) Int. Cl.

| | |
|---|---|
| ***A47L 13/20*** | (2006.01) |
| ***A47L 13/254*** | (2006.01) |
| ***A47L 13/257*** | (2006.01) |
| ***B25G 3/26*** | (2006.01) |
| ***B25G 1/10*** | (2006.01) |
| ***E01H 5/02*** | (2006.01) |

(52) U.S. Cl.

CPC ..... *A47L 13/20* (2013.01); *A47L 13/254* (2013.01); *A47L 13/257* (2013.01); *B25G 1/102* (2013.01); *B25G 3/26* (2013.01); *E01H 5/02* (2013.01)

(58) Field of Classification Search

CPC ..... A47L 13/20; A47L 13/254; A47L 13/257; B25G 1/102; B25G 3/26; E01H 5/02

See application file for complete search history.

(56) References Cited

U.S. PATENT DOCUMENTS

| | | | | | |
|---|---|---|---|---|---|
| 3,751,094 | A * | 8/1973 | Bohler | A01B 1/026 | 294/58 |
| 4,103,954 | A * | 8/1978 | Vaslas | A01B 1/22 | 294/54.5 |
| 4,407,039 | A * | 10/1983 | Moss | A47L 13/24 | 15/144.2 |
| 4,580,307 | A * | 4/1986 | Moss | A47L 13/59 | 15/144.2 |
| 5,331,720 | A * | 7/1994 | Beckingham | A01B 1/00 | 15/144.4 |

(Continued)

FOREIGN PATENT DOCUMENTS

| | | | | |
|---|---|---|---|---|
| CA | 2339559 A1 * | 9/2002 | ..... | B25G 1/00 |
| WO | WO-2008070903 A1 * | 6/2008 | ..... | A01B 1/026 |

*Primary Examiner* — Marc Carlson

(57) ABSTRACT

A double-handle mop includes a floor cleaning apparatus, a support shaft, a bend shaft, and a handle. The support and bend shaft are collectively optimized leverage to apply pressure to clean floors, without having to bend over. The bend shaft includes a first elongated section, a second elongated section, and a bend section as the bend shaft is formed into a V-shaped body. The first elongated section is terminally connected to a first shaft end of the support shaft. The second elongated section is terminally connected to a second shaft end of the support shaft. The first and second elongated sections are terminally connected to each other by the bend section, opposite the support shaft. The first shaft end is concentrically mounted with an extension tube of the floor cleaning apparatus. The second shaft end is adjacently connected with the handle that engages with the user.

16 Claims, 8 Drawing Sheets

(56) References Cited

U.S. PATENT DOCUMENTS

| | | | | |
|---|---|---|---|---|
| 6,485,076 | B1 * | 11/2002 | Chang | A01B 1/026 254/131.5 |
| 8,511,209 | B1 * | 8/2013 | Bishop | B25G 1/102 81/489 |
| D823,656 | S | 7/2018 | Ziamandanis | |
| 2002/0066163 | A1 * | 6/2002 | Lomax | B25G 1/102 16/430 |
| 2010/0175284 | A1 * | 7/2010 | Chang | E01H 5/02 37/434 |
| 2011/0099765 | A1 * | 5/2011 | Youssefieh | A46B 5/005 16/430 |
| 2013/0269131 | A1 * | 10/2013 | Mallett | B25G 1/102 15/144.1 |
| 2014/0132015 | A1 * | 5/2014 | Stachowski | E01H 5/02 294/51 |
| 2015/0201542 | A1 * | 7/2015 | Thresher | B25G 1/102 294/58 |
| 2015/0233069 | A1 * | 8/2015 | Fernandez, Sr. | E01H 5/061 37/241 |
| 2016/0024733 | A1 * | 1/2016 | Hanks | E01H 5/02 37/284 |
| 2018/0295766 | A1 * | 10/2018 | Thresher | A01B 1/026 |
| 2018/0327988 | A1 * | 11/2018 | Ziamandanis | E01H 5/02 |
| 2019/0224837 | A1 * | 7/2019 | Hoell, III | B25G 1/102 |
| 2019/0254495 | A1 * | 8/2019 | Zhang | A47L 11/24 |
| 2020/0318302 | A1 * | 10/2020 | Rueda | A01B 1/026 |

* cited by examiner

DOUBLE-HANDLE MOP

The current application is a continuation-in-part (CIP) application of a U.S. non-provisional application Ser. No. 16/042,291 filed on Jul. 23, 2018. The U.S. non-provisional application Ser. No. 16/042,291 claims a priority to a U.S. provisional application Ser. No. 62/630,933 filed on Feb. 15, 2018.

FIELD OF THE INVENTION

The present invention relates generally to a mop. More specifically, the present invention is a double-handle mop that enables a user to remove loose contamination such as dust, earth, and sand from the surface of the floor without having to bend over to apply pressure against the ground surface.

BACKGROUND OF THE INVENTION

A mop is a mass or bundle of coarse strings or yarn, etc., or a piece of cloth, sponge, or other absorbent material, attached to a pole or stick. It is used to soak up liquid, for cleaning floors and other surfaces, to mop up dust, or for other cleaning purposes. Even though there have been many different upgrades and changes done to the mop head, the handle has been consistent throughout all of those changes as the handle is shaped into a circular and elongated body. Standard mops can cause injuries due to awkward usage as the standard mops generally just have one handle that is connected to support the mop head. The user is meant to grasp the handle with both hands to properly use the standard mops. This requires the user to bend over, which is not conducive to protecting the user's back. Resultantly, there is a need for an updated handle that is easy to use and maintain, while simultaneously ensuring there is no related stress to the user's back. What is further needed is a device that enables the user to support the mop with both hands while standing in an upright position.

It is therefore an object of the present invention to provide a double-handle mop that includes two handles. The first handle is positioned similar to the existing handle position of most mops. The second handle is a bend handle that forms a V-shaped body. The second handle has two ancillary supports that are proximally connected to the first handle as the two ancillary supports are connected to each other by a bend section. The second handle enables the user to grasp the mop from multiple gripping positions, through two ancillary supports and the bend section, thus allowing the user to utilize the present invention without bending over at the waist or spine during floor clean up. Such motion prevents the user from worrying about damage to the user's back or body during use, while further allowing optimal leverage to apply pressure for scrubbing and cleaning floors.

DETAIL DESCRIPTIONS OF THE INVENTION

All illustrations of the drawings are for the purpose of describing selected versions of the present invention and are not intended to limit the scope of the present invention.

Figure 1:
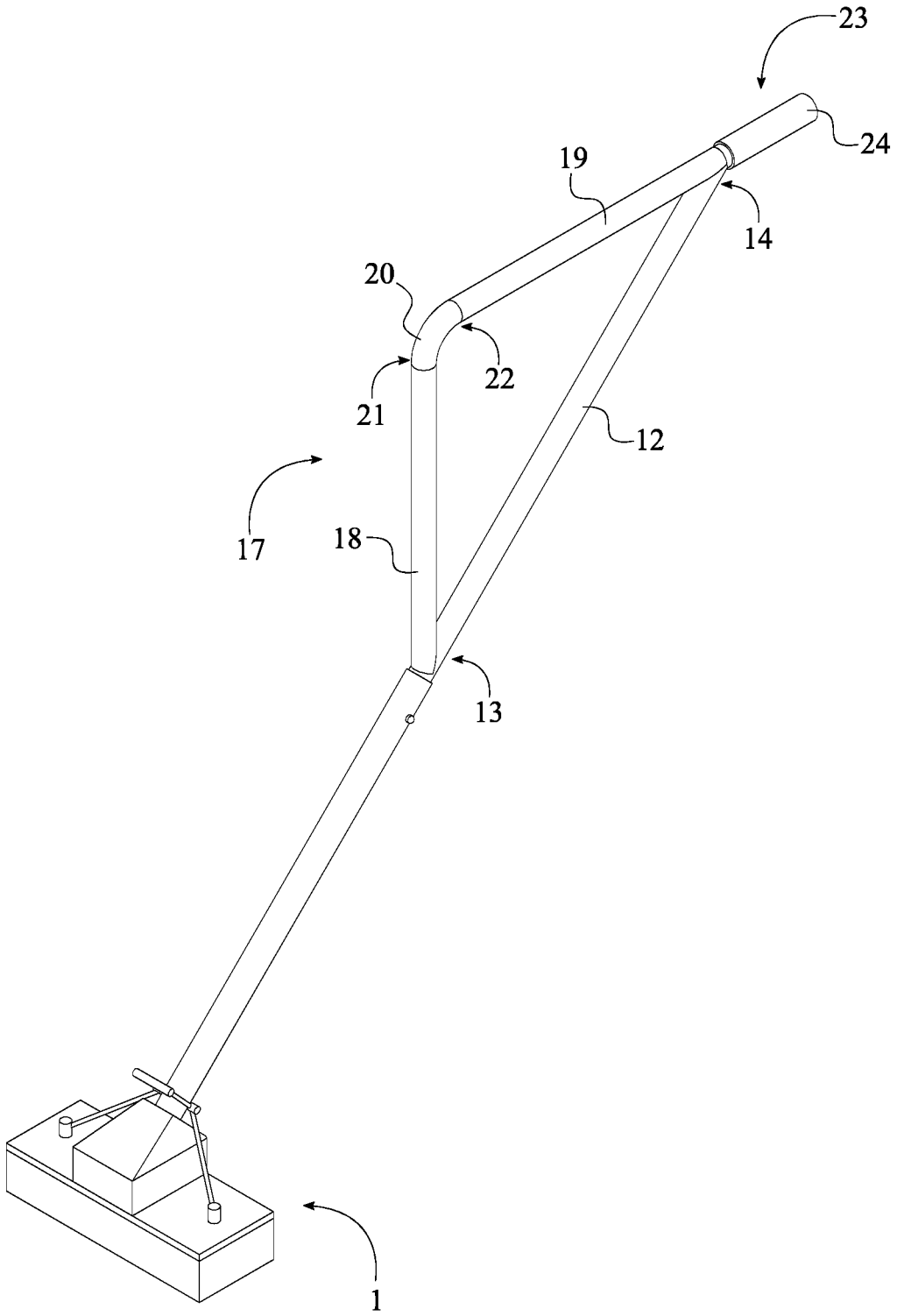
FIG. 1 is a front perspective view of the present invention.
Figure 2:
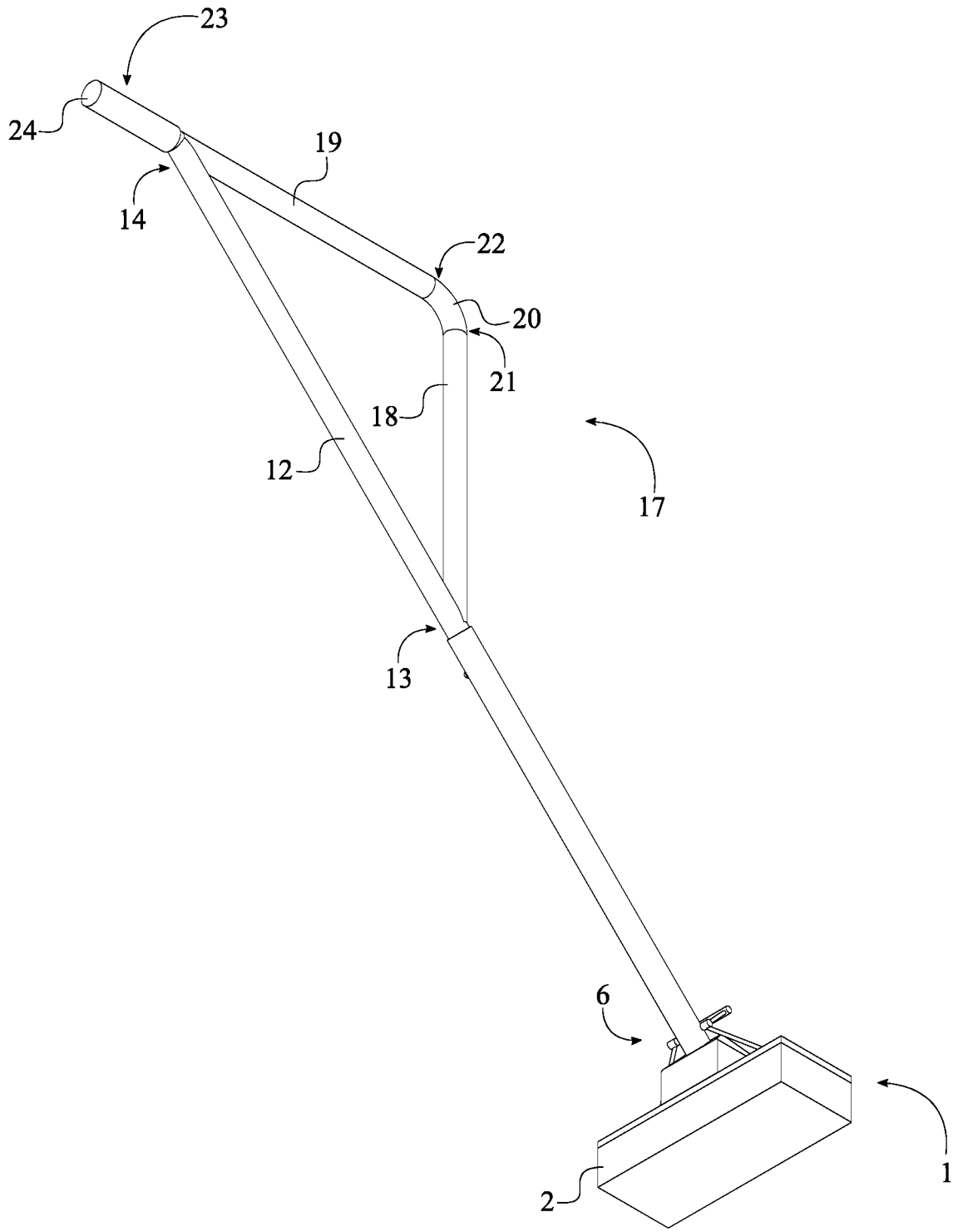
FIG. 2 is a rear perspective view of the present invention.
Figure 3:
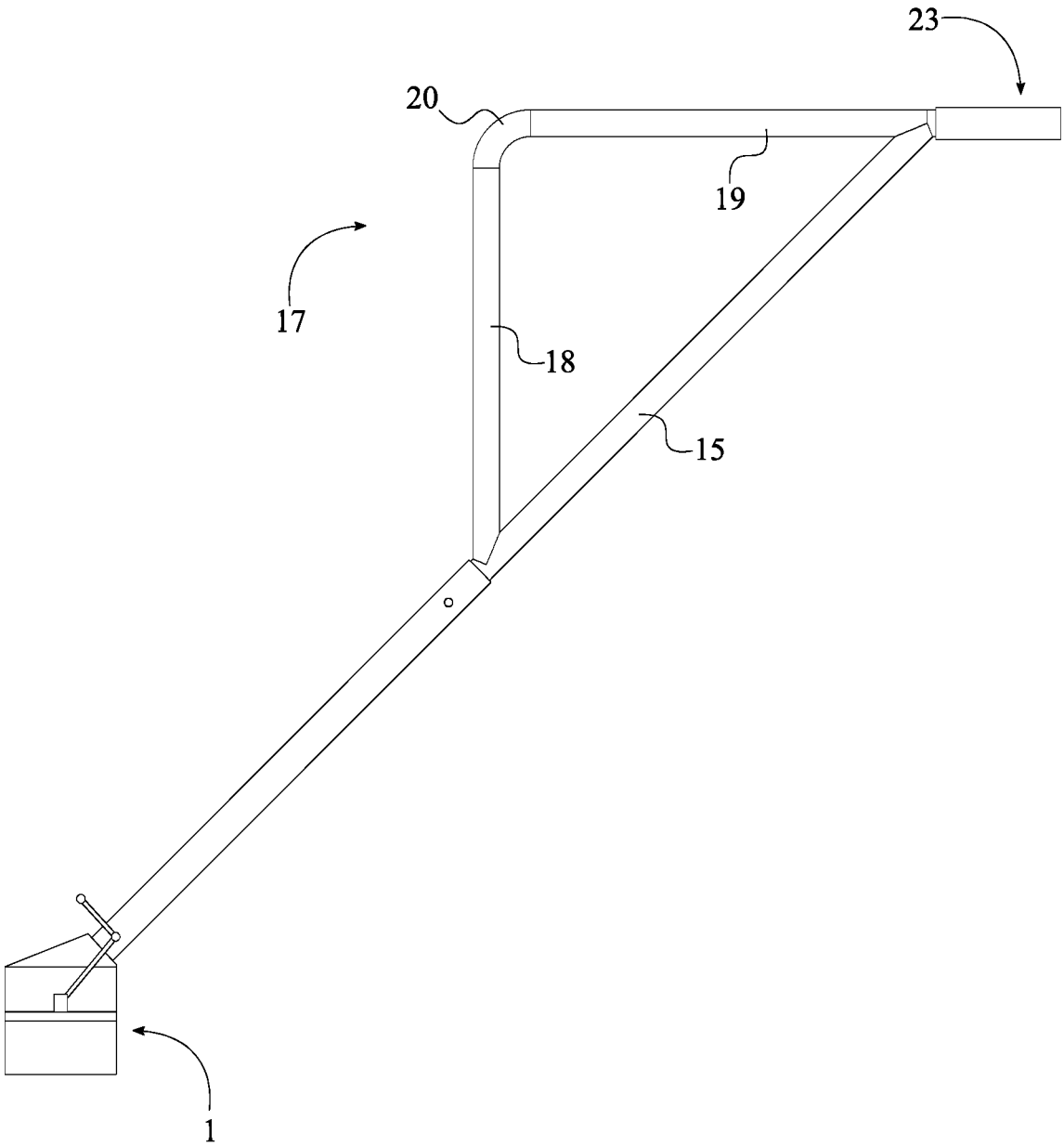
FIG. 3 is a side view of the present invention, wherein the support shaft is a straight body.

The present invention is a mop that enables the user to dry floors, remove contaminated liquid, clean floors, and remove dust that are accumulated on the ground. The components and their configuration of the present invention enable the user to accomplish abovementioned tasks without having to bend over at the waist or body during usage. The present invention comprises a floor cleaning apparatus 1, a support shaft 12, a bend shaft 17, a handle 23 as shown in FIG. 1. The bend shaft 17 enables the user to keep a straight back during usage and comprises a first elongated section 18, a second elongated section 19, and a bend section 20. In reference to the general configuration of the present invention as shown in FIG. 1-3, the support shaft 12 and the bend shaft 17 are connected to each other delineating a triangular profile for the combination of two shafts. The floor cleaning apparatus 1 is terminally connected to the support shaft 12 from one end. The handle 23 is terminally connected to the support shaft 12 and positioned opposite of the floor cleaning apparatus 1 thus completing the general configuration of the present invention.

The support shaft 12 functions as the base member within the present invention as the support shaft 12 allows the floor cleaning apparatus 1 and the handle 23 to be mounted from each end. Furthermore, the support shaft 12 stabilizes the bend shaft 17 and eliminates any elastic deformation that can occur due the added weight of the cleaning pressure. The bend shaft 17 allows the user to grasp the present invention during usage so that the user can maintain a straight back. In reference to FIG. 1-2, the first elongated section 18 is terminally connected to a first shaft end 13 of the support shaft 12 so that the bend shaft 17 can be connected from one end. The second elongated section 19 is terminally connected to a second shaft end 14 of the support shaft 12 so that the bend shaft 17 can be connected from the opposite end. The bend section 20 is then able to connect the first elongated section 18 and the second elongated section 19 thus completing the overall structure between the support shaft 12 and the bend shaft 17. More specifically, the first elongated section 18 is terminally connected to a first end 21 of the bend section 20, opposite of the first shaft end 13. The second elongated section 19 is terminally connected to a second end 22 of the bend section 20, opposite of the second shaft end 14. Resultantly, the support shaft 12 and the bend shaft 17 are able to complete the triangular profile of the present invention while the bend section 20, the first shaft end 13, and the second shaft end 14 delineate the corners of the triangular profile.

Figure 4:
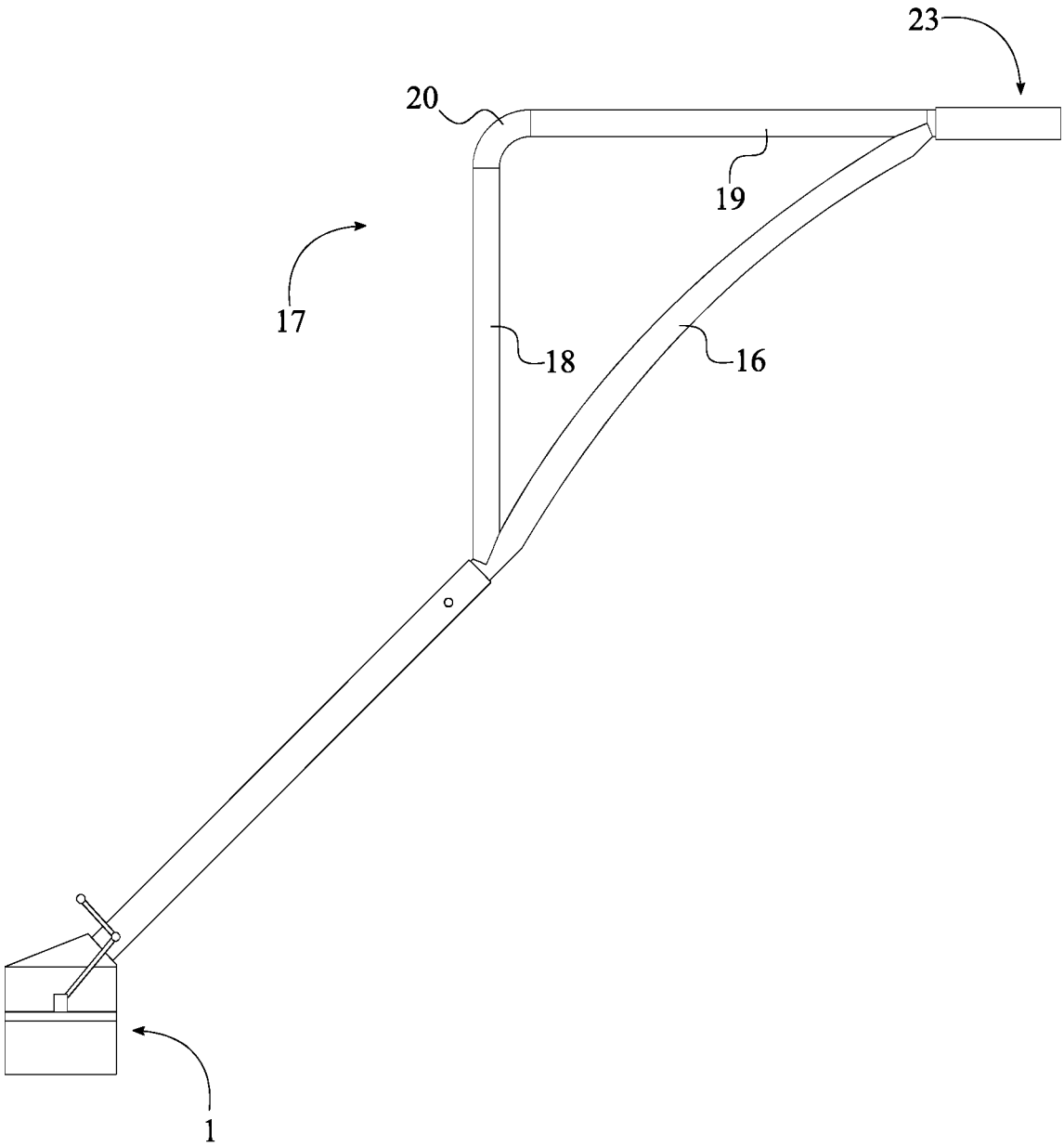
FIG. 4 is a side view of the present invention, wherein the support shaft is a curved body.

In one embodiment of the present invention, the support shaft 12 can be a straight body 15 from the first shaft end 13 to the second shaft end 14 as shown in FIG. 3. In another embodiment of the present invention, the support shaft 12 can be a curved body 16 from the first shaft end 13 to the second shaft end 14 as shown in FIG. 4. Furthermore, a convex side of the curved body 16 is oriented towards the bend shaft 17. The straight body 15 and the curved body 16 provide an aesthetical difference between each embodiment. However, both the straight body 15 and the curved body 16 maintain the same structural integrity within the present invention to eliminate any elastic deformation that may otherwise occur within the bend shaft 17.

Figure 5:
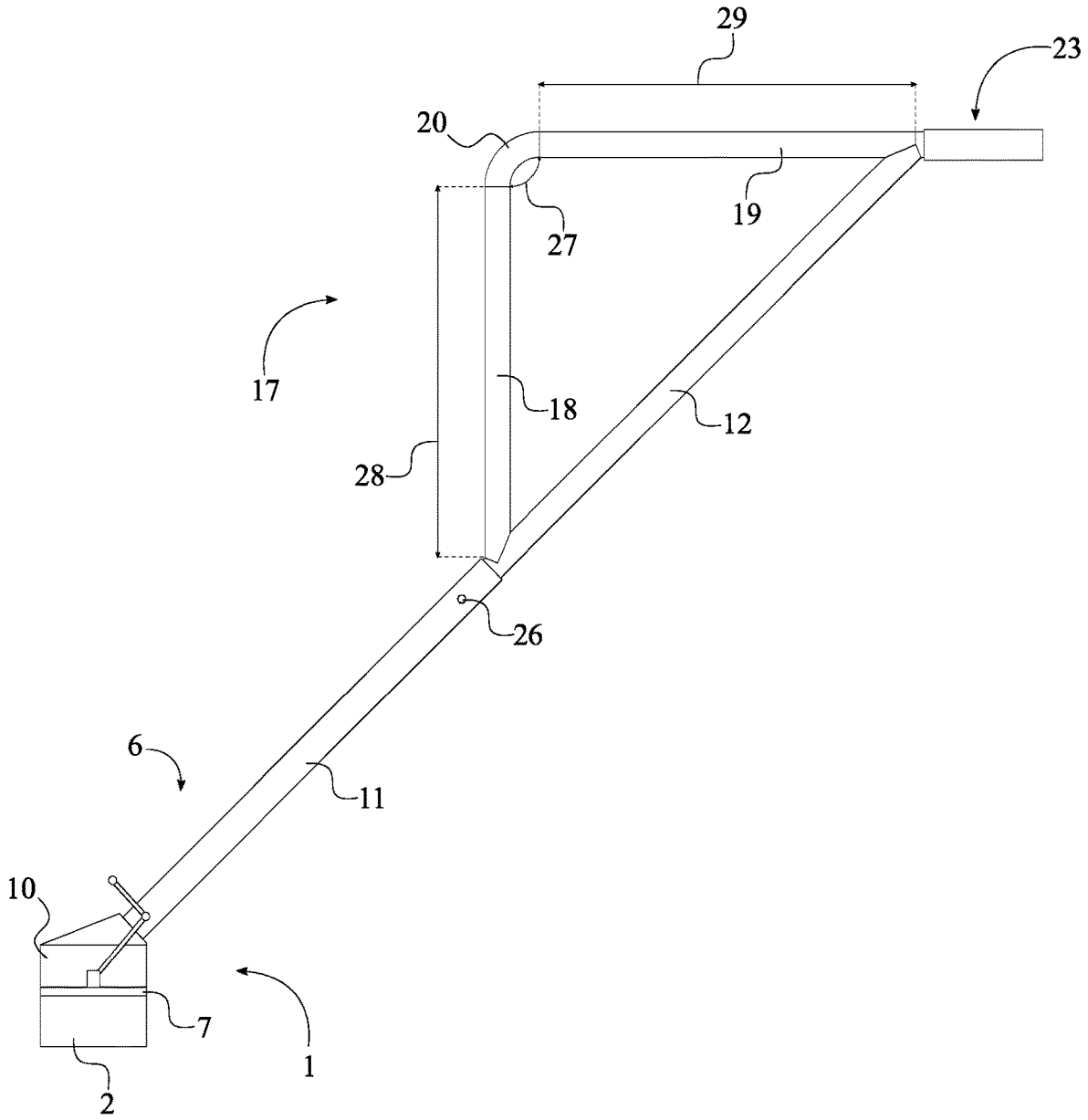
FIG. 5 is a side view of the present invention, showing the acute angle between the first elongated section and the second elongated section.

In reference to FIG. 5, the first elongated section 18 and the second elongated section 19 delineate an acute angle 27 about the bend section 20. Preferably, the acute angle 27 can be measured in degrees within the present invention. In reference to FIG. 5, a length 28 of the first elongated section 18 is preferably equal to a length 29 of the second elongated section 19. However, the length 28 of the first elongated section 18 can also be longer or shorter to the length 29 of the second elongated section 19 with respect to different embodiment of the present invention. Collectively, the acute angle 27 and the equal length between the first elongated section 18 and the second elongated section 19 position the bend section 20 in line with the handle 23 when the floor cleaning apparatus 1 is positioned flat against a floor. As a result, the user can comfortably grasp the handle 23 and the bend section 20 or the second elongated section 19 during the usage of the present invention without having to bend down. In other words, the user can grasp the handle 23 with one hand thus partially securing the present invention. The user can then fully secure the present invention by grasping the bend section 20 or the second elongated section 19 with the other hand. Since the bend section 20 is positioned in line with the second shaft end 14, the user can simply extend their arm and grasp the bend section 20 or the second elongated section 19 without having to bend down.

In reference to FIG. 1-2, the first shaft end 13 is concentrically mounted within a mounting body 6 of the floor cleaning apparatus 1 so that the support shaft 12 and the floor cleaning apparatus 1 can be secured within the present invention. More specifically, an extension tube 11 of the mounting body 6 and the first shaft end 13 are mounted to each other by a fastener 26 so that the floor cleaning apparatus 1 can be detached when necessary. As a result, the first shaft end 13 can be interchanged with multiple floor cleaning apparatus 1 that are different in width, shape, or material to encompass different types of cleaning purposes. Additionally, when an old floor cleaning apparatus 1 is worn out and unusable, the worn-out floor cleaning apparatus 1 can be changed into a new floor cleaning apparatus 1 through the fastener 26. The present invention preferably utilizes a spring loaded button that is integrated into the first shaft end 13 and a corresponding opening that traverses through extension tube 11 as the fastener 26. However, the fastener is not limited to the preferred fastening mechanism and can include, but is not limited to, a screw fastener, a male and female treaded fastener, a clamp fastener, a snap fastener, and a latch fastener.

The floor cleaning apparatus 1 functions similar to existing mop heads so that dust can be collected and removed or liquid can be removed or spread within the present invention. In reference to FIG. 5, the floor cleaning apparatus 1 further comprises a mop head 2 in addition to the mounting body 6. The mop head 2 is utilized as the cleaning body that comes into the contact with the floor. The mop head 2 is adjacently attached to the mounting body 6 and positioned opposite of the first shaft end 13, about the mounting body 6. The mounting body 6 that secures the mop head 2 to the first shaft end 13 comprises a base 7, an adaptor 10, and the extension tube 11. More specifically, the base 7 is terminally connected to the adaptor 10. The extension tube 11 is terminally connected to the adaptor 10 and positioned opposite of the base 7. As a result, when the floor cleaning apparatus 1 is connected to the first shaft end 13, the extension tube 11 is positioned adjacent to the first shaft end 13 so that the first shaft end 13 can be terminally mounted to the extension tube 11 opposite of the adaptor 10. The mop head 2 is attached to the base 7 and positioned opposite of the extension tube 11 about the adaptor 10. The adaptor 10 functions as a supporting structure in between the base 7 and the extension tube 11 so that the structural integrity of the mounting body 6 can be improved. However, the mounting body 6 can also be configured without the adaptor 10 without departing from the spirit and scope of the invention. Furthermore, the basic configuration of the base 7 can differ to accommodate different embodiments of the present invention.

Figure 6:
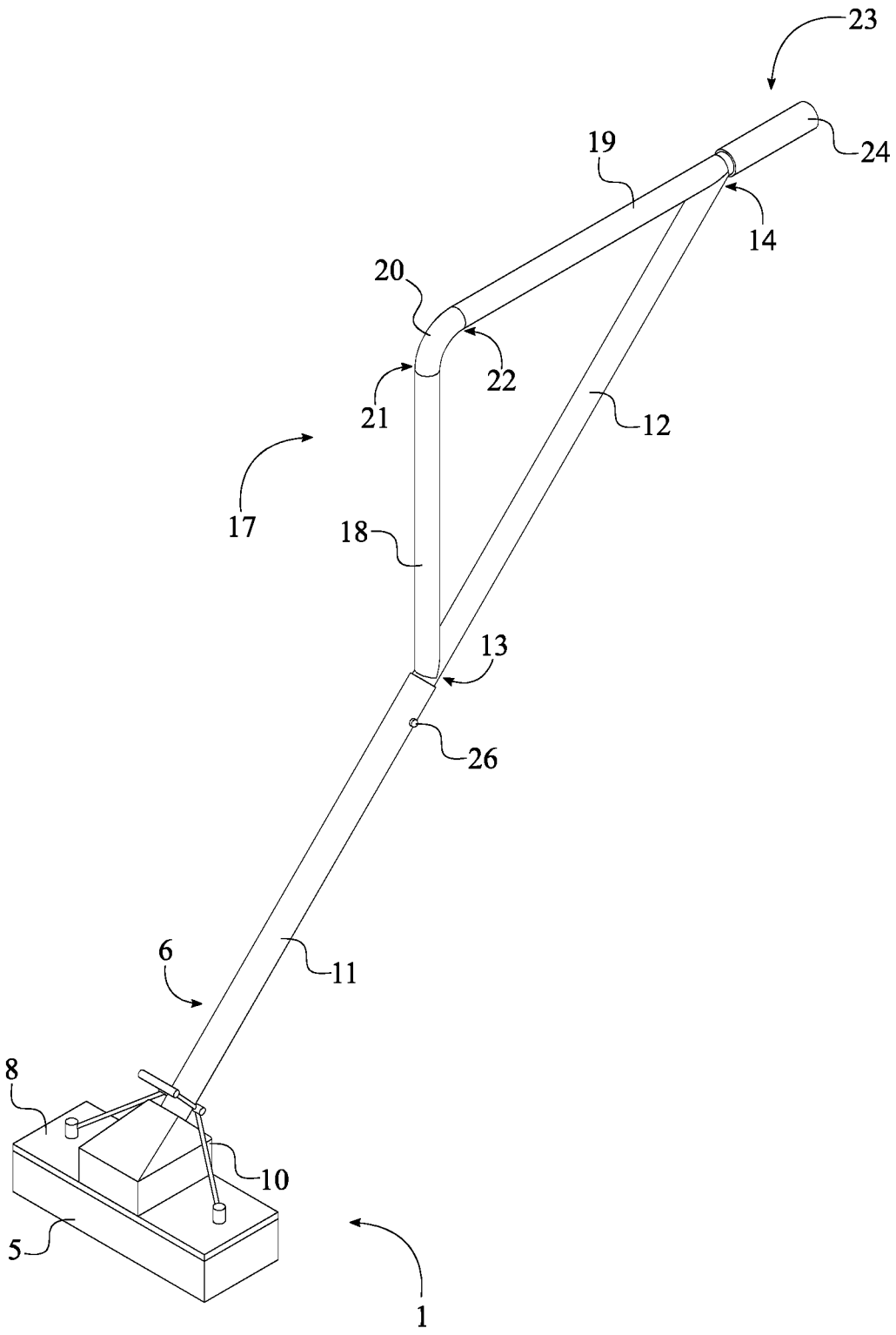
FIG. 6 is a front perspective view of the present invention, showing a detailed view of the mounting body wherein the mop head is the sponge mop.

In reference to a first embodiment of the present invention, the base 7 is a flat panel 8 as shown in FIG. 6. More specifically, the flat panel 8 is connected to the adaptor 10 so that the flat panel 8 and the adaptor 10 shares the same central axis. The mop head 2 is a sponge mop 5 and is perimetrically connected around the flat panel 8. The sponge mop 5 functions as an absorbent material so that liquid can be absorbed or spread around the floor. Additionally, the first embodiment of the present invention can comprise a liquid draining mechanism that is operated by the user to drain liquid from the sponge mop 5. The liquid draining mechanism is configured onto the mounting body 6 and does not interfere with the functionality of the support shaft 12, the bend shaft 17, and the handle 23.

Figure 7:
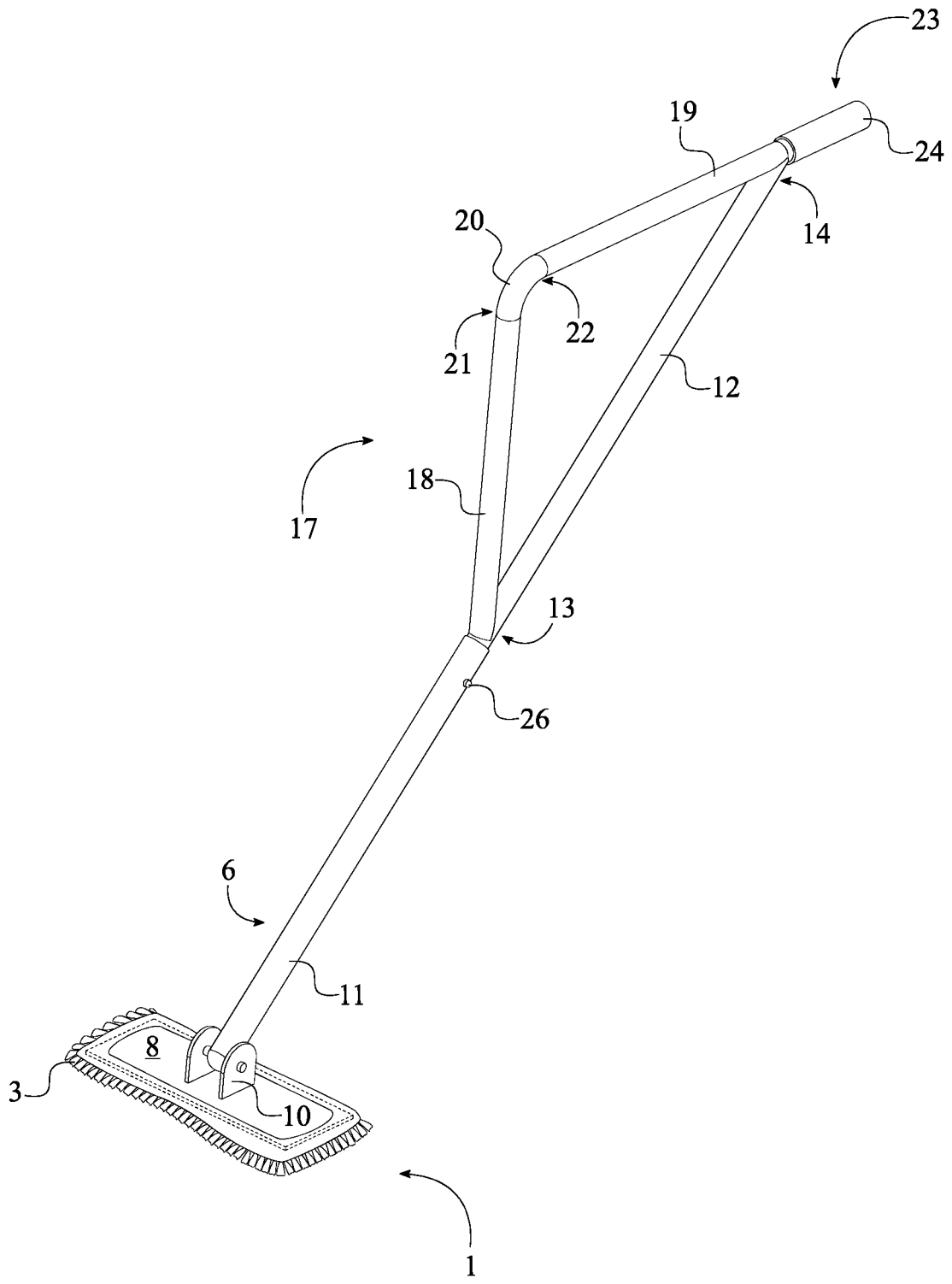
FIG. 7 is a front perspective view of the present invention, showing a detailed view of the mounting body wherein the mop head is the dust mop.

In reference to a second embodiment of the present invention, the base 7 is a flat panel 8 as shown in FIG. 7. More specifically, the flat panel 8 is pivotably connected to the adaptor 10 so that the flat panel 8 is able to move 360 degrees around the adaptor 10. The mop head 2 is a dust mop 3 and is perimetrically attached around the flat panel 8. The dust mop 3 comprises a layer of fabric and an elastic edge so that dust particles can be removed and compiled into a dust pile. More specifically, the layer of fabric is positioned adjacent to the flat panel 8 and orients toward the floor so that the layer of fabric can retain the dust particles during the cleaning process. The elastic edge is tethered around the flat panel 8 and positioned adjacent to the adaptor 10 so that the layer of fabric can be contained around the flat panel 8 during the cleaning process. Furthermore, the elastic edge enables the easy attachment and removal of the dust mop 3 within the present invention.

Figure 8:
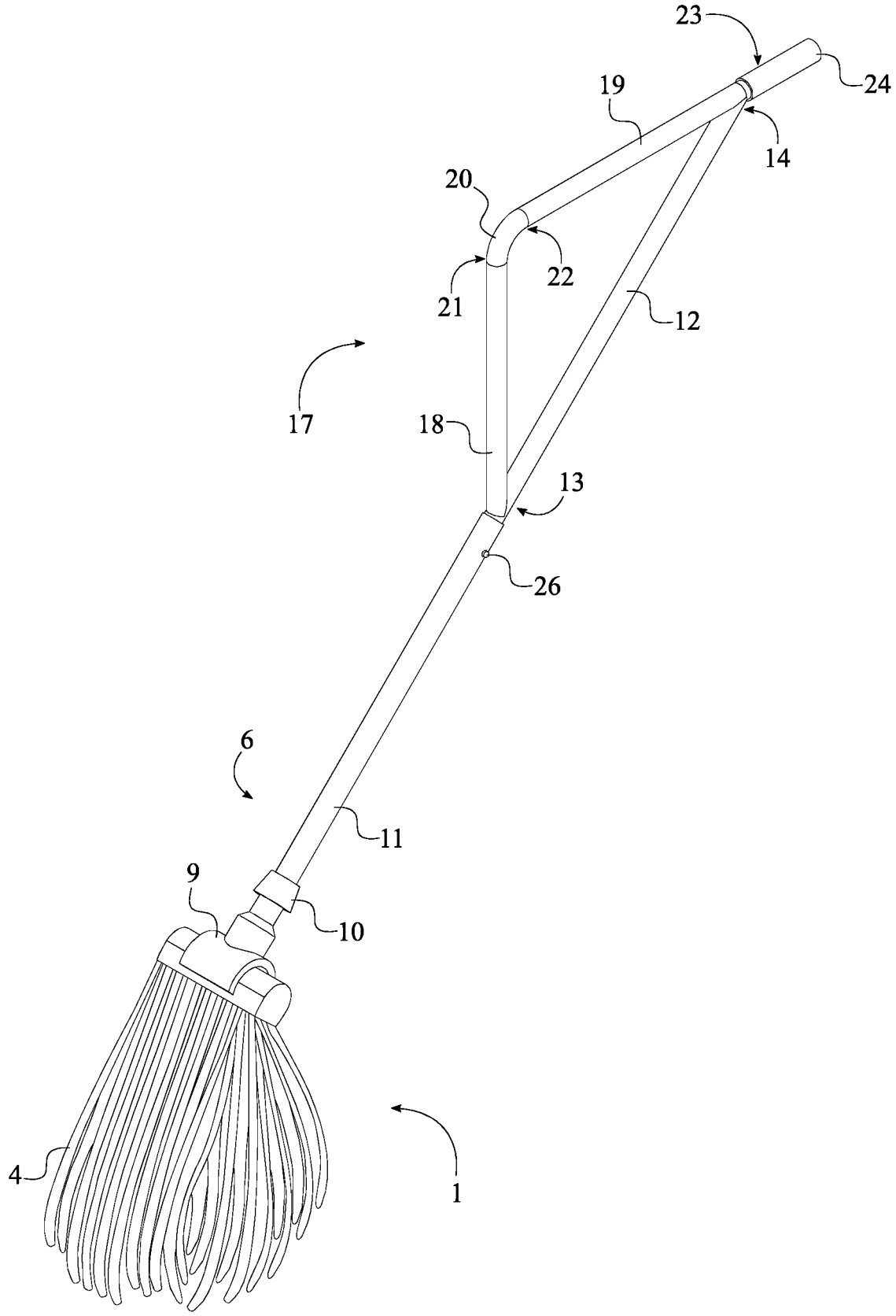
FIG. 8 is a front perspective view of the present invention, showing a detailed view of the mounting body wherein the mop head is the wet mop.

In reference to a third embodiment of the present invention, the base 7 is a clamp fastener 9 as shown in FIG. 8. More specifically, the clamp fastener 9 is axially connected to the adaptor 10. The mop head 2 is a wet mop 4 and is crimped into the clamp fastener 9. The wet mop 4 functions similar to the first embodiment and so that liquid can be absorbed or spread around the floor. Additionally, the wet mop 4 can comprise a plurality of coarse strings or yarn that is connected to each other by an edge. The edge provides a strengthened surface area for the wet mop 4 as the edge is generally crimped into the clamp fastener 9. Furthermore, the clamp fastener 9 enables the easy attachment and removal of the wet mop 4 within the present invention.

In reference to FIG. 1-2, the second shaft end 14 is adjacently connected to the handle 23 so that the support shaft 12 and the handle 23 can be secured within the present invention. The present invention further comprises a gripping body 24 as the gripping body 24 is externally connected around the handle 23. More specifically, the gripping body 24 provides ergonomic surface area to grasp the handle 23 so that the friction between the handle 23 and the user's hand can be enhanced. Furthermore, the overall shape of the gripping body 24 is determined upon the shape of the handle 23 due to the fact that the gripping body 24 fully encloses the handle 23.

The present invention may further comprise a grip to enhance the friction between the user's hand and the bend section 20 or the second elongated section 19. The grip is a generally flexible, preferably rubber or foam extrusion that wraps around the bend section 20 or the second elongated section 19.

Although the invention has been explained in relation to its preferred embodiment, it is to be understood that many other possible modifications and variations can be made without departing from the spirit and scope of the invention as hereinafter claimed.

What is claimed is:

1. A double-handle mop comprises:
a floor cleaning apparatus;
a support shaft;
a bend shaft;
a handle;
the bend shaft comprises a first elongated section, a second elongated section, and a bend section;
the first elongated section being terminally connected to a first shaft end of the support shaft;
the second elongated section being terminally connected to a second shaft end of the support shaft;
the first elongated section being terminally connected to a first end of the bend section, opposite of the first shaft end;
the second elongated section being terminally connected a second end of the bend section, opposite of the second shaft end;
the first shaft end being concentrically mounted within a mounting body of the floor cleaning apparatus;
the second shaft end being adjacently connected to the handle; and
the support shaft is a curved body.

2. The double-handle mop as claimed in claim 1 comprises:
the floor cleaning apparatus further comprises a mop head;
the mop head being adjacently attached to the mounting body; and
the mop head being oppositely positioned to the first shaft end, about the mounting body.

3. The double-handle mop as claimed in claim 1 comprises:
the floor cleaning apparatus further comprises a mop head;
the mounting body comprises a base, an adaptor, and an extension tube;
the base being terminally connected to the adaptor;
the extension tube being terminally connected to the adaptor, opposite of the base;
the mop head being attached to the base; and
the first shaft end being terminally mounted to the extension tube, opposite of the adaptor.

4. The double-handle mop as claimed in claim 3 comprises:
the base being a flat panel;
the mop head being a dust mop;
the flat panel being pivotably connected to the adaptor; and
the dust mop being perimetrically attached around the flat panel.

5. The double-handle mop as claimed in claim 3 comprises:
the base being a flat panel;
the mop head being a sponge mop;
the flat panel being connected to the adaptor; and
the sponge mop being perimetrically connected around the flat panel.

6. The double-handle mop as claimed in claim 3 comprises:
the base being a clamp fastener;
the mop head being a wet mop;
the clamp fastener being connected to the adaptor; and
the wet mop being crimped into the clamp fastener.

7. The double-handle mop as claimed in claim 3 comprises:
a fastener; and
the extension tube and the first shaft end being mounted to each other by the fastener.

8. The double-handle mop as claimed in claim 1 comprises:
a gripping body; and
the gripping body being externally connected around the handle.

9. The double-handle mop as claimed in claim 1, wherein the first elongated section and the second elongated section delineate an acute angle about the bend section.

10. A double-handle mop comprises:
a floor cleaning apparatus;
a support shaft;
a bend shaft;
a handle;
the floor cleaning apparatus comprises a mounting body and a mop head;
the bend shaft comprises a first elongated section, a second elongated section, and a bend section;
the mounting body comprises a base, an adaptor, and an extension tube;
the first elongated section being terminally connected to a first shaft end of the support shaft;
the second elongated section being terminally connected to a second shaft end of the support shaft;
the first elongated section being terminally connected to a first end of the bend section, opposite of the first shaft end;
the second elongated section being terminally connected a second end of the bend section, opposite of the second shaft end;
the base being terminally connected to the adaptor;
the extension tube being terminally connected to the adaptor, opposite of the base;
the mop head being adjacently attached to the mounting body;
the mop head being attached to the base;
the mop head being oppositely positioned to the first shaft end, about the mounting body;
the first shaft end being terminally mounted to the extension tube, opposite of the adaptor;
the first shaft end being concentrically mounted within the mounting body;
the second shaft end being adjacently connected to the handle; and
the support shaft is a curved body.

11. The double-handle mop as claimed in claim 10 comprises:
the base being a flat panel;

the mop head being a dust mop;

the flat panel being pivotably connected to the adaptor; and the dust mop being perimetrically attached around the flat panel.

12. The double-handle mop as claimed in claim 10 comprises:

the base being a flat panel;

the mop head being a sponge mop;

the flat panel being connected to the adaptor; and the sponge mop being perimetrically connected around the flat panel.

13. The double-handle mop as claimed in claim 10 comprises:

the base being a clamp fastener;

the mop head being a wet mop;

the clamp fastener being connected to the adaptor; and the wet mop being crimped into the clamp fastener.

14. The double-handle mop as claimed in claim 10 comprises:

a fastener; and the extension tube and the first shaft end being mounted to each other by the fastener.

15. The double-handle mop as claimed in claim 10 comprises:

a gripping body; and the gripping body being externally connected around the handle.

16. The double-handle mop as claimed in claim 10, wherein the first elongated section and the second elongated section delineate an acute angle about the bend section.

* * * * *